US009557054B2

(12) United States Patent
Amati

(10) Patent No.: US 9,557,054 B2
(45) Date of Patent: Jan. 31, 2017

(54) BURNERS FOR OVENS OR GRILLS

(75) Inventor: Carlo Amati, Cassago Brianza (IT)

(73) Assignee: ACTEK S.r.l. (IT)

( * ) Notice: Subject to any disclaimer, the term of this patent is extended or adjusted under 35 U.S.C. 154(b) by 265 days.

(21) Appl. No.: 14/343,263

(22) PCT Filed: Sep. 4, 2012

(86) PCT No.: PCT/IB2012/054551

§ 371 (c)(1),
(2), (4) Date: Mar. 6, 2014

(87) PCT Pub. No.: WO2013/035031

PCT Pub. Date: Mar. 14, 2013

(65) Prior Publication Data

US 2014/0230803 A1 Aug. 21, 2014

(30) Foreign Application Priority Data

Sep. 7, 2011 (IT) ..... MI2011A1609

(51) Int. Cl.
*F23D 14/10* (2006.01)
*F23D 14/26* (2006.01)
(Continued)

(52) U.S. Cl.
CPC ..... *F23D 14/10* (2013.01); *F23D 14/105* (2013.01); *F23D 14/26* (2013.01); *F23D 14/58* (2013.01); *F23D 14/583* (2013.01); *F24C 3/087* (2013.01)

(58) Field of Classification Search
CPC ..... F23D 14/105; F23D 14/26; F23D 14/583; F23D 14/10; F23D 14/58
(Continued)

(56) References Cited

U.S. PATENT DOCUMENTS 2,150,819 A * 3/1939 Brumbaugh ..... F23D 14/58 239/544
4,986,254 A 1/1991 Haen et al.
(Continued)

FOREIGN PATENT DOCUMENTS

EP 0797049 A2 9/1997
FR 1500383 A 11/1967
(Continued)

OTHER PUBLICATIONS

International Search Report PCT/ISA/210 for International Application No. PCT/IB2012/054551 dated on Mar. 21, 2013.
(Continued)

*Primary Examiner* — Gregory Huson
*Assistant Examiner* — Nikhil Mashruwala
(74) *Attorney, Agent, or Firm* — MH2 Technology Law Group LLP

(57) ABSTRACT

A burner for an oven or grill may include a flat and elongated body extending in a major longitudinal direction and confining an inner chamber configured to receive a comburent and combustible mixture. The body may include two half-shells mutually superposed and coupled in mirror-image relationship and including edge portions defining a coupling plane. A first series of flame holes may define a first flaming front and a second series of flame holes may define a second flaming front, at the coupling plane, on opposite sides of the inner chamber. The body may include a connecting portion between the first and second flaming fronts at an end of the inner chamber. The connecting portion may be defined by connecting walls of the half-shells extending parallel to the coupling plane in a sequence of depressions and elevations between the first and second flaming fronts and configured to transfer flame.

20 Claims, 8 Drawing Sheets

(51) Int. Cl.
*F23D 14/58* (2006.01)
*F24C 3/08* (2006.01)

(58) Field of Classification Search
USPC 126/39 E, 39 H, 39 R, 40; 431/283, 60, 278
See application file for complete search history.

(56) References Cited

U.S. PATENT DOCUMENTS 5,139,417 A * 8/1992 Ghassemzadeh ..... F23D 14/06 126/39 H
5,492,469 A * 2/1996 Oda ..... F23D 14/06 431/263
5,899,681 A * 5/1999 Maughan ..... F23D 14/26 431/286
5,915,956 A 6/1999 Kwiatek et al.
6,318,993 B1 * 11/2001 Huang ..... F23D 14/06 126/39 R
7,527,495 B2 * 5/2009 Yam ..... F23D 14/06 126/40
8,011,358 B2 * 9/2011 Galindo ..... F23D 14/06 126/39 E
2005/0138789 A1 6/2005 Offredi
2008/0210217 A1 9/2008 Offredi
2011/0079212 A1 4/2011 Bettinzoli

FOREIGN PATENT DOCUMENTS

FR 1514654 A 2/1968
GB 1444333 A 7/1976
WO WO-2004005799 A1 1/2004
WO WO-2009157022 A1 12/2009

OTHER PUBLICATIONS

Written Opinion PCT/ISA/237 for International Application No. PCT/IB2012/054551 dated on Mar. 21, 2013.

* cited by examiner

Fig.2
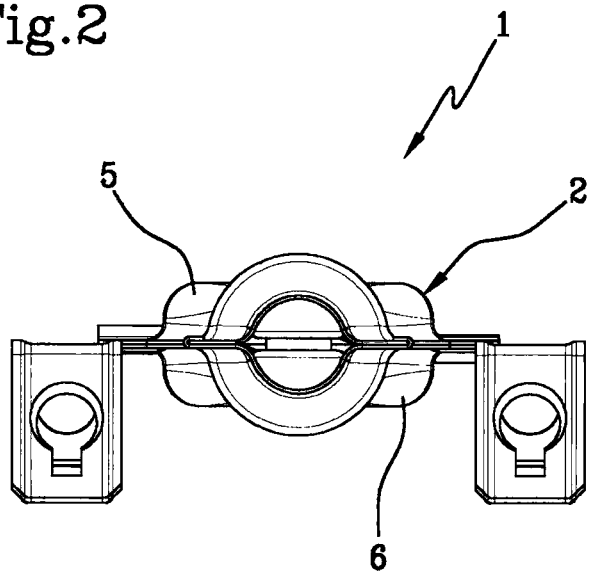
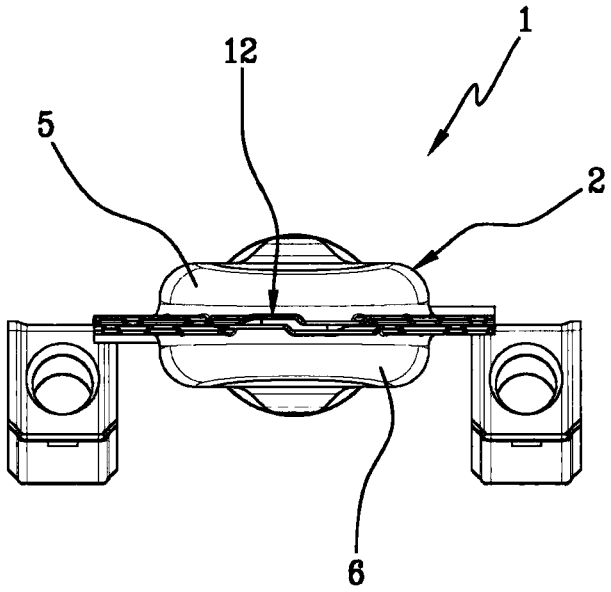
Fig.3

Fig.8
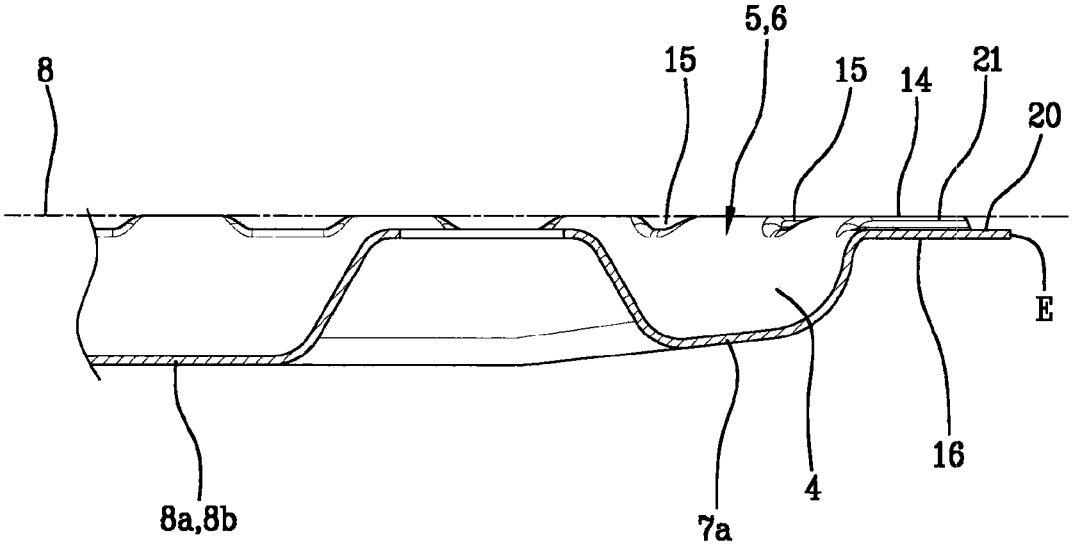
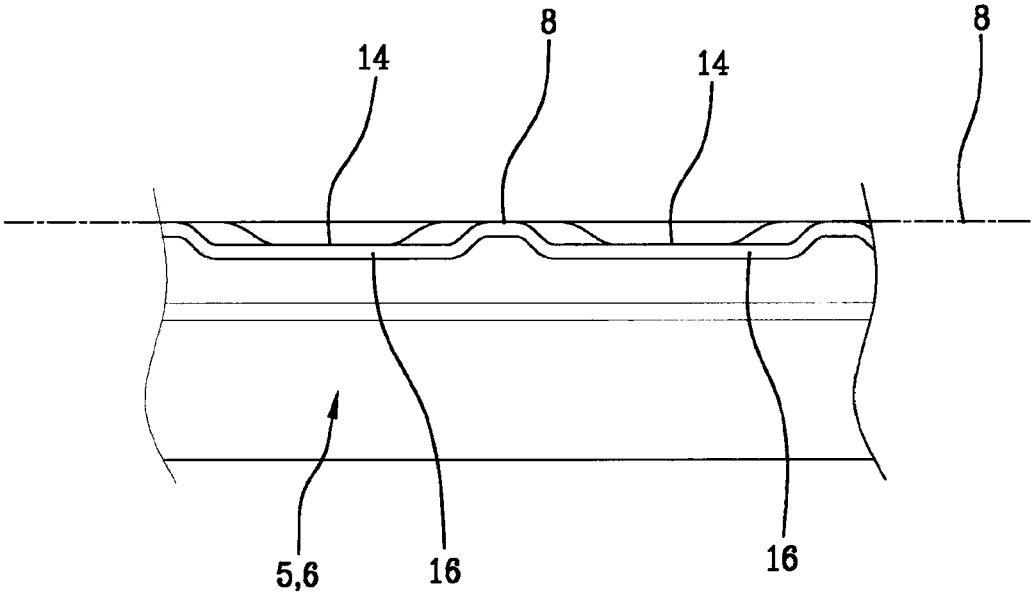
Fig.9

BURNERS FOR OVENS OR GRILLS

CROSS-REFERENCE TO RELATED APPLICATION(S)

This application is a national stage entry from International Application No. PCT/IB2012/054551, filed on Sep. 4, 2012, in the Receiving Office of the International Bureau of the World Intellectual Property Organization ("WIPO") and published as International Publication No. WO 2013/035031 A2, which claims priority from Italian Patent Application No. MI 2011 A 001609, filed on Sep. 7, 2011, in the Italian Patent and Trademark Office, the entire contents of both of which are incorporated herein by reference.

TECHNICAL FIELD

This invention relates to a burner for oven or grill.

BACKGROUND ART

More specifically, this invention relates to a burner for oven or grill with a pilot flame.

There are prior art tubular burners formed by three elements forming the main chamber and an auxiliary chamber allowing the flame to be piloted. The main chamber is designed to receive the comburent/combustible mixture and it is provided with main flame holes. The auxiliary chamber forms a thin hollow space at the main flame holes for transmitting the flame.

Making the above-mentioned burners is complex and expensive since it requires the formation of three elements different to each other and subsequently coupled with strict dimensional tolerances in such a way as to guarantee the correct dimension of the flame transmission hollow space.

A burner is known from patent FR1500383 formed by a flat plate with a rectangular shape formed by two shaped half-shells. Two series of flame holes positioned substantially on the longest sides are alternated by a pilot flame generated by channels positioned centrally on the shortest side. The channels of the pilot flame are formed by the head coupling between shaped walls of the two half-shells. This arrangement generates channels with a cylindrical shape which are separate from each other. That means that the coupling and shape precision of the two half-shells is essential for obtaining a reliable pilot flame. In effect, each wall of a half-shell delimiting a channel must be perfectly aligned with the corresponding wall of the other half-shell, in such a way as to obtain cylindrical channels which are separate from each other. A burner of this type requires special attention both in the step for machining the two half-shells and in the step for coupling the two half-shells. Consequently, the production costs are high and the reliability is low since any possible errors in the shape and/or in the coupling generate uncertainties in the repeatability of the piloting of the flame between separate burners or in the same burner at different temperatures.

DISCLOSURE OF THE INVENTION

In this context, the technical purpose which forms the basis of this invention is to propose a burner for oven or grill which overcomes the above mentioned disadvantages of the prior art.

More specifically, the aim of this invention is to provide a burner for oven or grill which is able to limit the number of parts and their assembly whilst guaranteeing the ability to pilot the flame.

Even more specifically, the aim of this invention is to provide a burner for oven or grill wherein a determined degree of efficiency of piloting the flame is also guaranteed in the presence of variations in shape and/or coupling and/or temperature.

The technical purpose indicated and the aims specified are substantially achieved by a burner for oven or grill comprising the technical features described in one or more of the appended claims. The dependent claims correspond to different embodiments of the invention.

BRIEF DESCRIPTION OF THE DRAWINGS

Further features and advantages of the invention are more apparent in the detailed description below, with reference to a preferred, non-limiting, embodiment of a burner for oven or grill as illustrated in the accompanying drawings, in which:

FIG. 2 is a rear view of the burner of FIG. 1 according to the arrow II;

FIG. 3 is a front view of the burner of FIG. 1 according to the arrow III;

FIG. 8 illustrates a longitudinal cross-section of the enlarged detail of FIG. 7;

FIG. 9 illustrates schematic side and enlarged view of a detail of FIG. 6;

DETAILED DESCRIPTION OF THE PREFERRED EMBODIMENTS OF THE INVENTION

Figure 1:
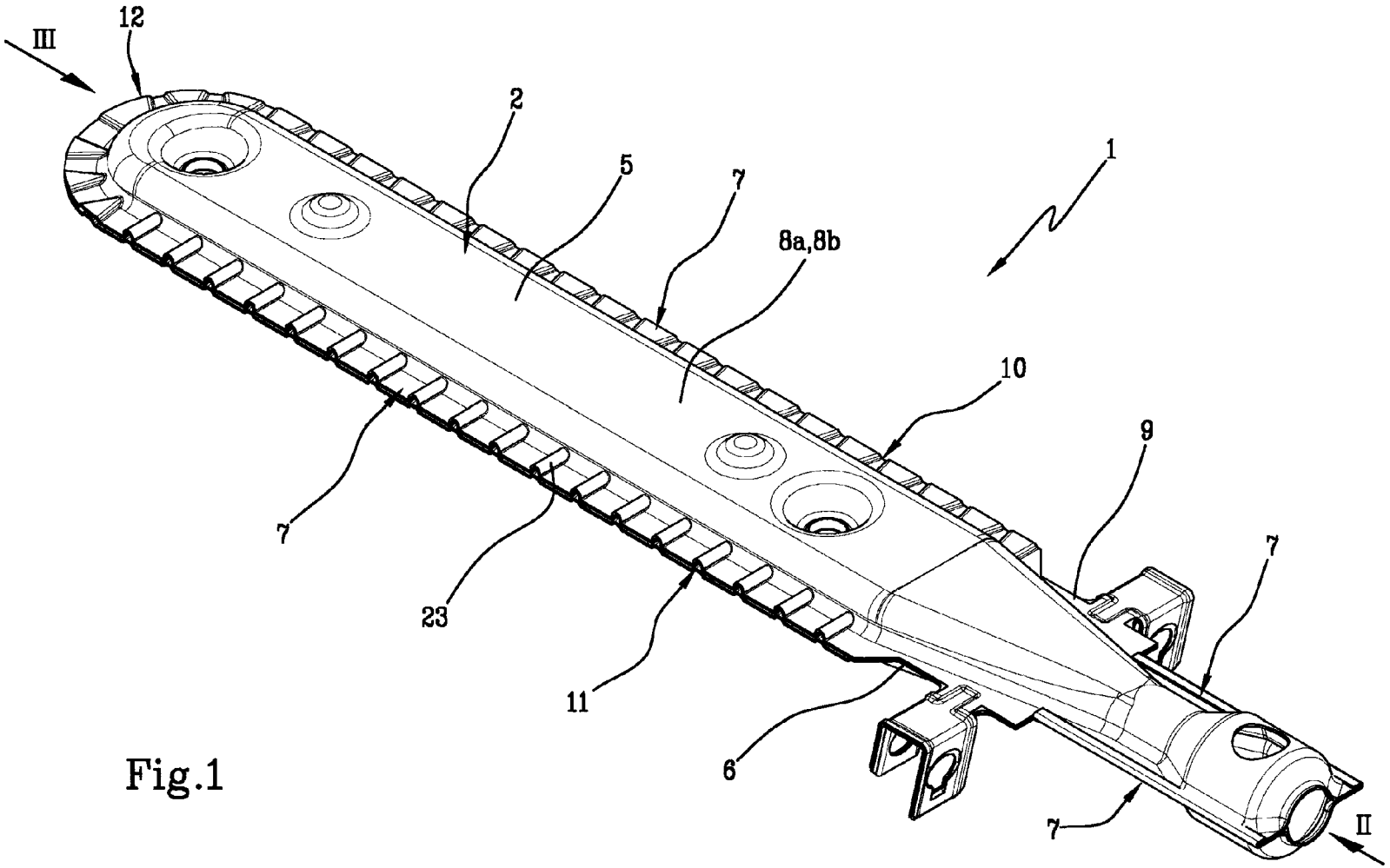
FIG. 1 is a schematic perspective view of a burner according to the invention.

The numeral 1 denotes in its entirety a burner for oven or grill according to this invention.

The burner 1 comprises a flat and elongated body 2 according to the main longitudinal direction 3. The body 2 delimits an inner chamber 4 designed to receive to receive a comburent/combustible mixture.

According to a possible embodiment, the body 2 is formed by two half-shells 5, 6 mutually superposed and coupled.

The numeral 7 indicates edge portions of each half-shell defining a coupling plane 8 of the two half-shells. The edge portions extend for a predetermined length L towards the edge of the body up to a shaped section 7*a* of the half-shell defining walls delimiting the inner chamber. Advantageously, the edge portions represent a closed profile about the inner chamber.

According to a possible embodiment, the coupling plane 8 is positioned parallel to an upper 8*a* and/or lower base 8*b* of the body. The terms "upper" and "lower" are used with reference to the positioning of the burner in the oven wherein the coupling plane 8 and the upper and lower bases 8*a*, 8*b* are substantially horizontal.

The numeral 9 indicates an end portion of each half-shell defining, in the body of the burner, a Venturi pipe. Advantageously, the edge portions also extend at the Venturi pipe.

The body 2 comprises a first series of flame holes 10 defining a first flaming front and a second series of flame holes 11 defining a second flaming front. The first and second flaming fronts are positioned at the coupling plane 8 of the two half-shells, on opposite sides of the inner chamber and in communication therewith. For example, each series of flame holes is made between the two half-shells at a shaped hollow space, as described below. One half-shell delimits, for example, an upper portion of the flame holes whilst the other half-shell delimits, for example, a lower portion of the flame holes.

According to a possible embodiment, the first flaming front and the second flaming front are rectilinear and preferably parallel to each other and to the longitudinal direction of the body 3. With reference to the positioning of the burner inside the oven, the flaming fronts are positioned substantially in a horizontal plane.

Advantageously, the body 2 comprises a connecting portion 12 between the first flaming front and the second flaming front obtained at the coupling plane of the two half-shells at an end of the inner chamber. This end is, for example, positioned on the opposite side to the Venturi pipe.

Advantageously, the connecting portion is defined by respective connecting walls 13 of the two half-shells forming part of the edge portion. The connecting walls 13 extend parallel to the coupling plane 8 in a sequence of depressions and elevations positioned between the first flaming front and the second flaming front and designed to form flame transferring means. Advantageously, each connecting wall comprises a sequence of depressions and elevations along a direction of travel extending between the first flaming front and the second flaming front along the coupling plane 8. Each depression and each elevation preferably extends for the entire length L of the connecting portion (or of the edge portion), from the inner chamber to an outer edge E of the edge portion.

According to a possible embodiment, the connecting portion is of curved shape, preferably in the form of an arc of a circle extending, for example, through approximately 180°. Advantageously, the depressions and the elevations alternate along a curved direction which connects the first and the second flaming front.

In a mirror-image superposed and coupled condition of the two half-shells so as to form the body of the burner, a depression of the first half-shell substantially corresponds to an elevation of the second half-shell, taking into account an inner surface 14 of the connecting portion. The coupled depression and elevation preferably have different shapes.

Figure 7:
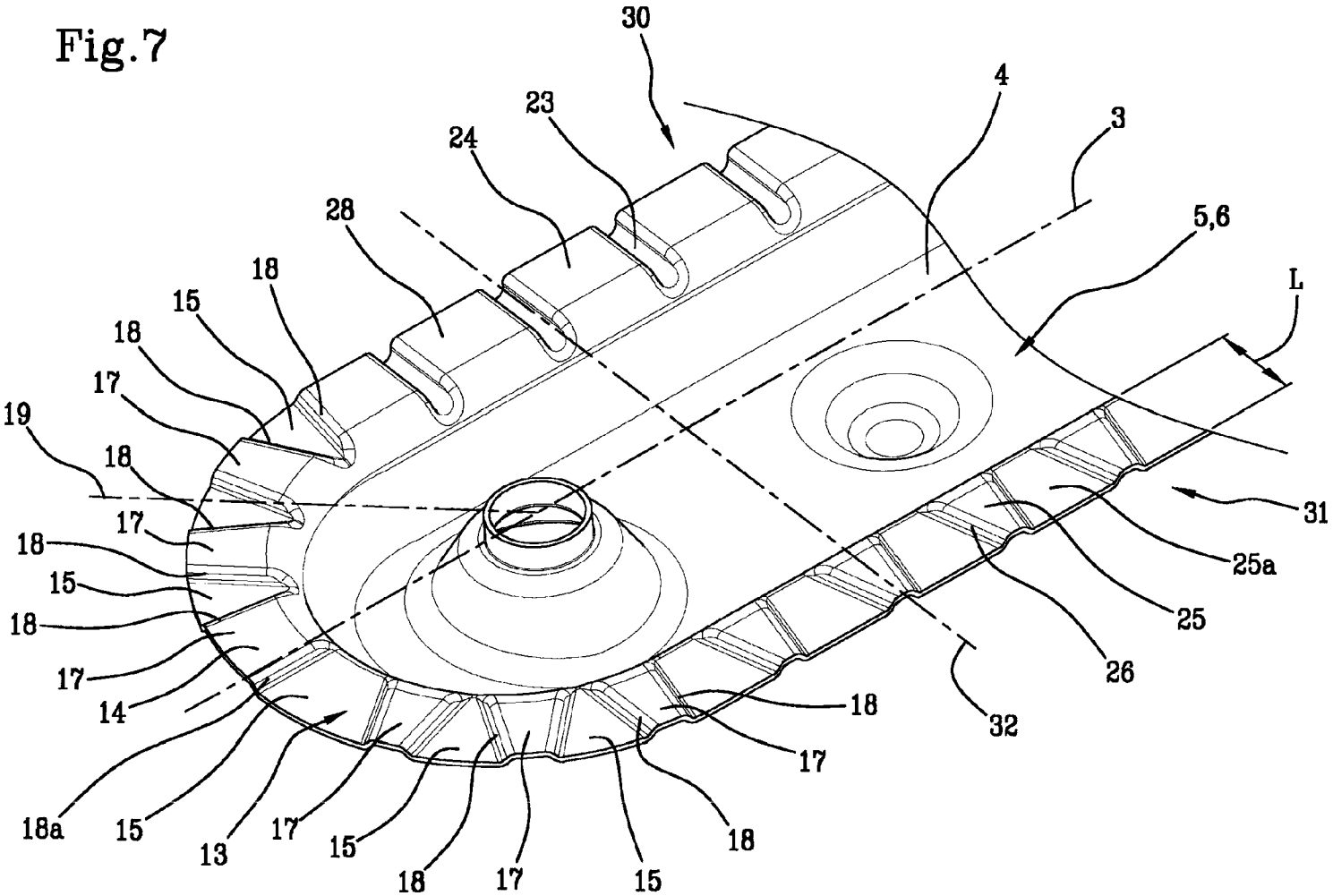
FIG. 7 illustrates an enlarged detail of FIG. 6.

The expression "inner surface" means a surface directly facing the other half-shell. With reference to FIG. 7, there are six depressions 15 considering the inner surface 14 (corresponding to as many elevations if the outer surface 16 is considered, that is, the one facing the outside of the body, from the opposite side of the other half-shell). The numeral 17 indicates respective elevations, considering the inner surface 14, they alternate with the depressions 15.

Figure 4:
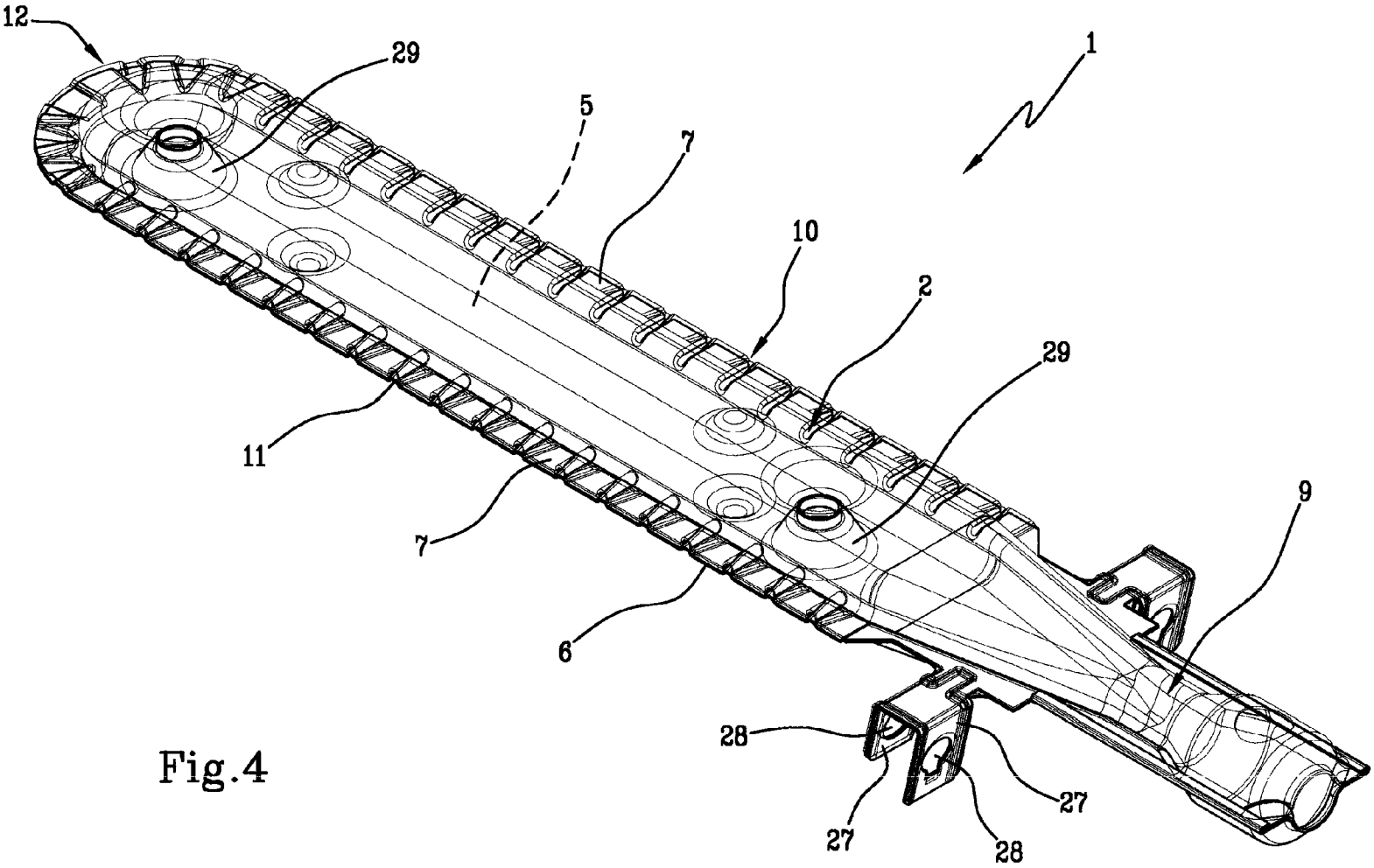
FIG. 4 shows the burner of FIG. 1 wherein a half-shell is illustrated with a fine and in a transparent manner.
Figure 5:
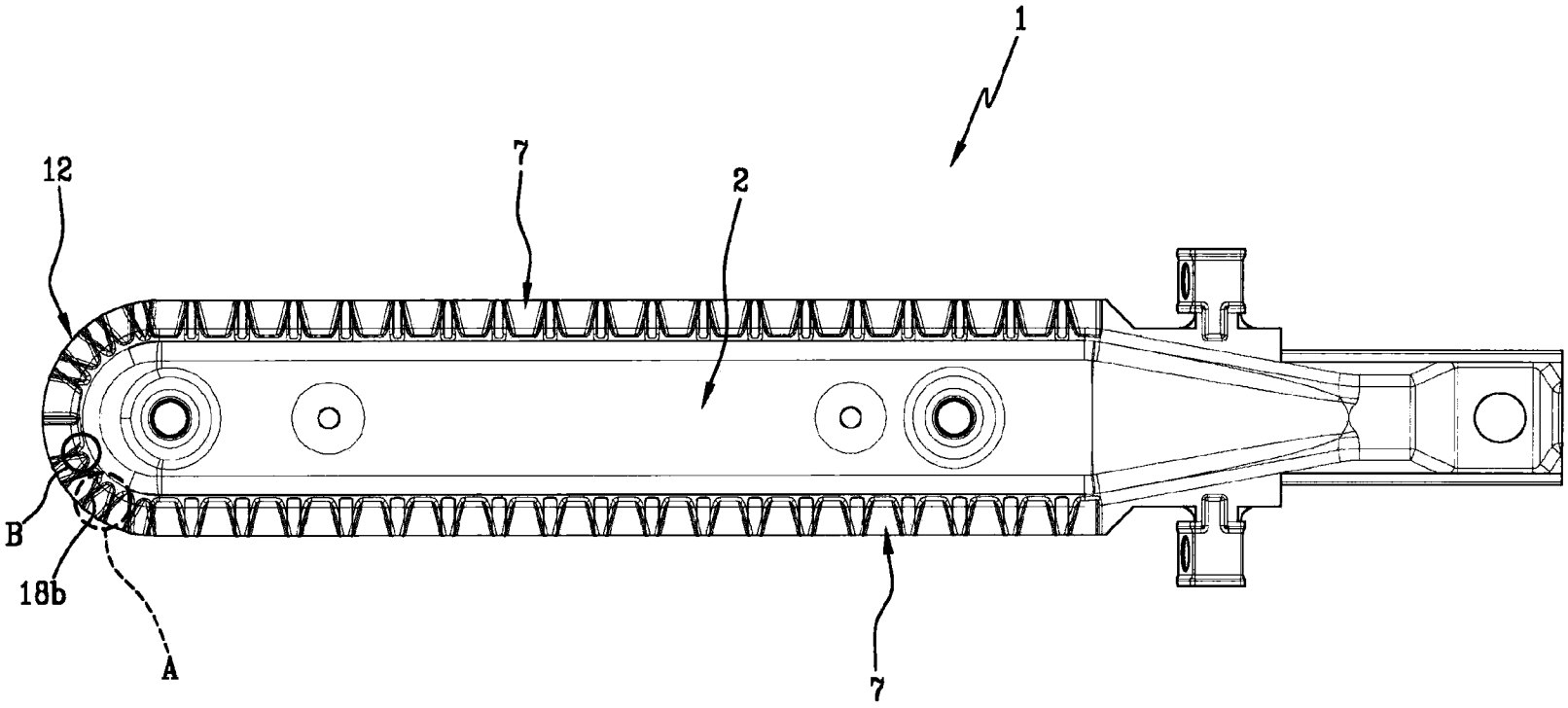
FIG. 5 illustrates a plan views of the burner of FIG. 1.
Figure 6:
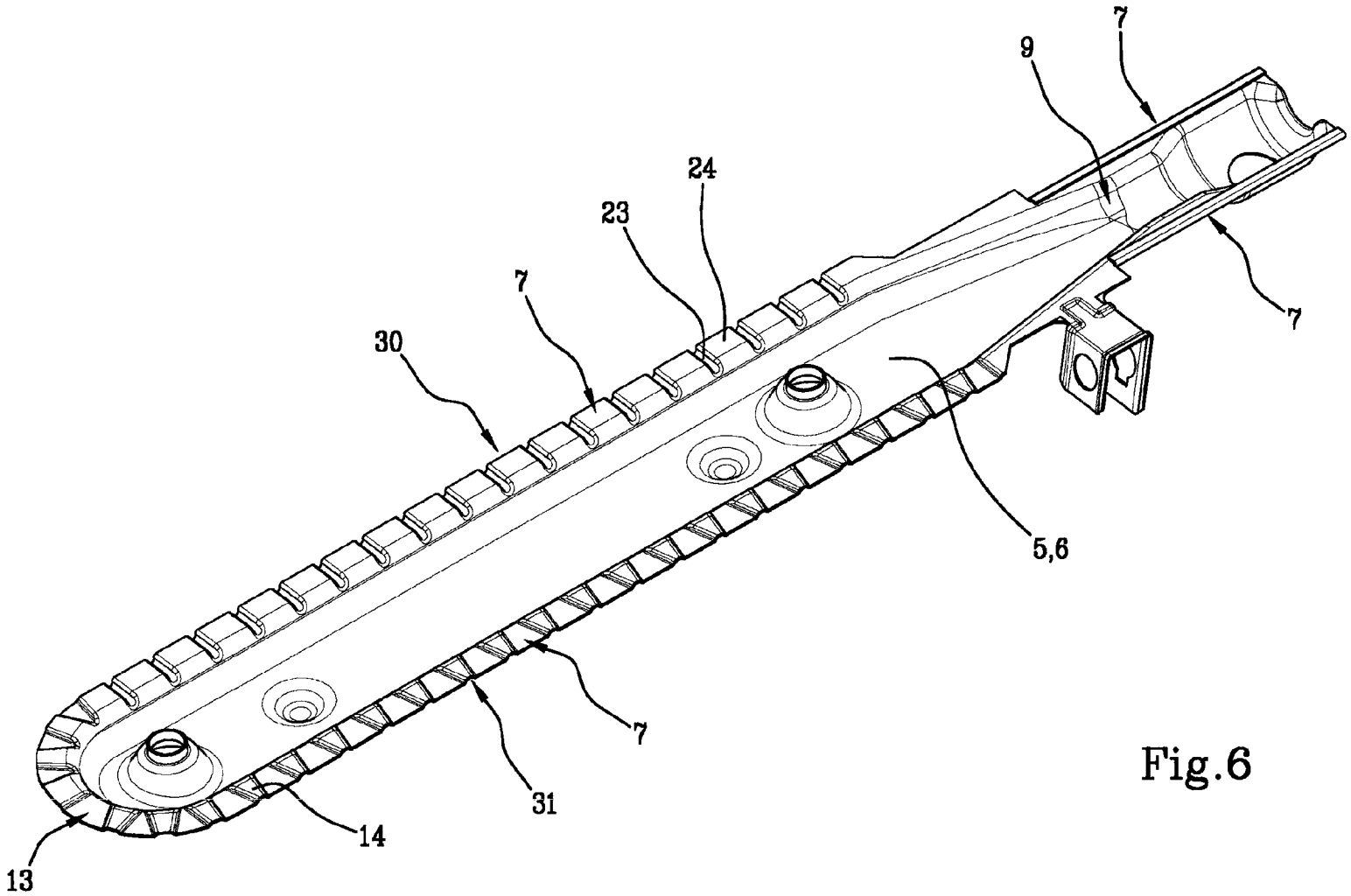
FIG. 6 illustrates a schematic perspective view of a half-shell of the burner according to this invention.

According to a possible embodiment, the depressions and elevations of the connecting portion are delimited by side walls 18. At least one side wall of at least one depression or elevation of the first half-shell intersects a side wall of a corresponding depression or elevation of the second half-shell. This feature is, for example, illustrated in detail in FIGS. 4 and 5 where the upper half-shell is illustrated in a transparent manner in order to see the relationship with the lower half-shell. Detail A illustrated in FIG. 5 shows two intersections 18*b* between walls 18 of corresponding depressions and/or elevations of the two half-shells. The term "corresponding" means depressions and/or elevations which face each other in the same position in an assembled configuration of the burner body.

According to a possible embodiment, at least one side wall of at least one depression or elevation of the connecting portions is inclined in the coupling plane 8 relative to a radial direction 19 of the connecting portion.

According to a possible embodiment, at least one side wall of at least one depression or elevation of the first half-shell is parallel to a side wall of a corresponding depression or elevation of the second half-shell preferably at an intermediate portion of the connecting portion. This side wall is indicated in the drawings with numeral 18*a*.

According to a possible embodiment, the depressions and elevations of the connecting portion comprise a flat base 20, 21 parallel to the coupling plane 8. Advantageously, the coupling plane 8 is coincident with an inner surface 14 of the connecting wall, at the flat base 21 of the depressions and/or elevations.

According to a possible embodiment, the connecting wall of the first half-shell and the connecting wall of the second half-shell positioned side by side with the first half-shell are identical and, in the mirror-image coupled condition so as to form the body of the burner, a depression of the first half-shell substantially corresponds to an elevation of the second half-shell, taking into account an inner surface of the connecting portion. A depression of the first half-shell corresponds with an elevation of the second half-shell superposing for a substantial extension of them. The different shape of depressions and/or elevations and the presence of relative walls 18 which intersect each other generate an incomplete overlapping. For example, detail B in FIG. 5 shows a section wherein an elevation of the first half-shell is superposed by an elevation of the second half-shell, considering the inner surface of the connecting portion.

Advantageously, the connecting portion may comprise, with reference to the inner surface 14, depressions of triangular or trapezoidal shape whose vertex or minor base is positioned towards the inside of the body.

Figure 10:
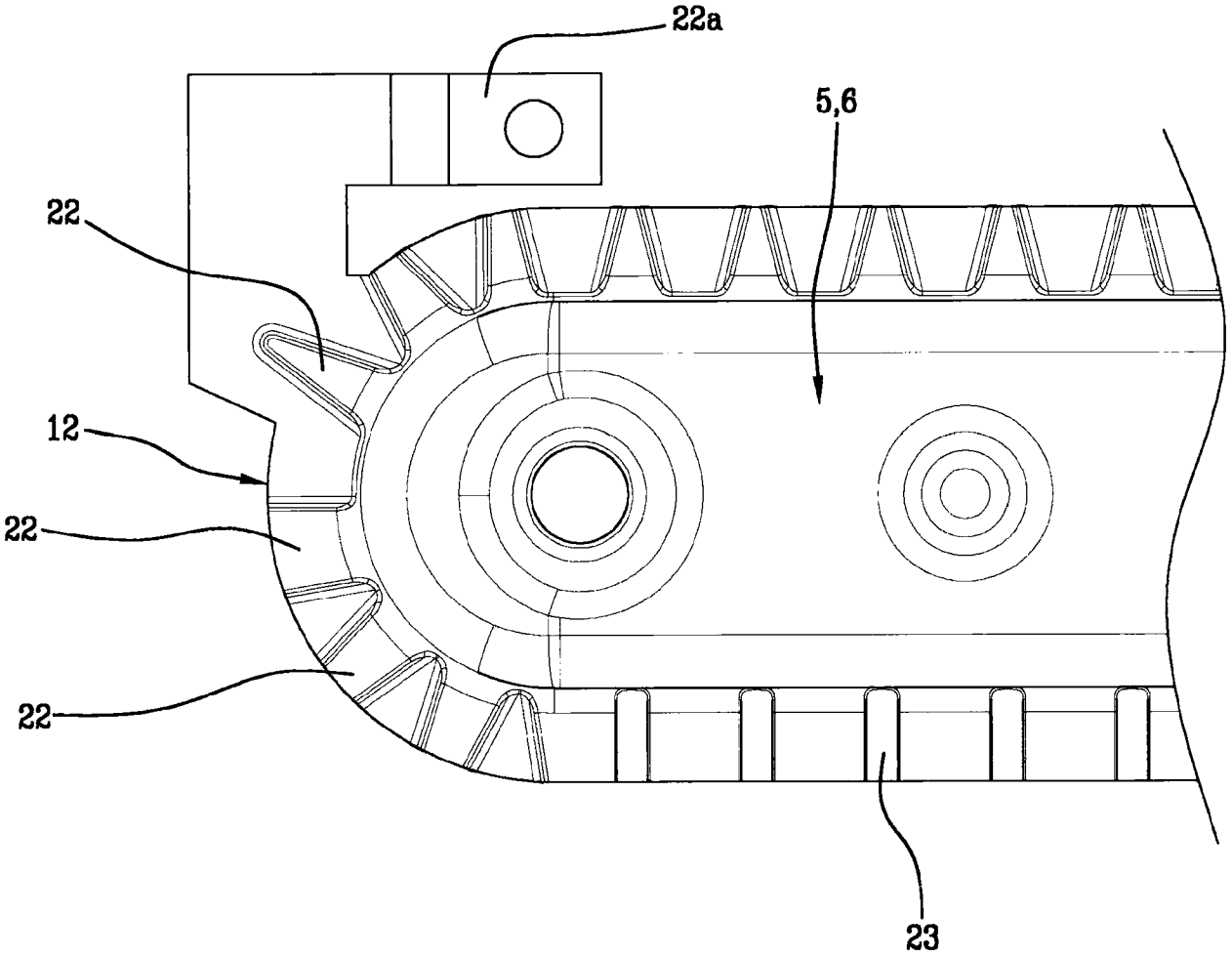
FIG. 10 illustrates a schematic plan view of an enlarged detail of a possible embodiment of a half-shell of the burner according to this invention.

According to a possible embodiment for example illustrated in FIG. 10, each half-shell is associated with a supporting foot 22*a*, preferably made in one piece with the half-shell. Preferably, the supporting foot is positioned at the connecting portion 12 and comprises extensions 22 of corresponding depressions of the connecting portion with reference to an inner surface of the body, designed to allow the passage of secondary air.

Advantageously, the connecting portion, as described above and illustrated, is configured to transfer the flame between the first flaming front and the second flaming front forming part of the piloting of the burner.

In the coupling between the two half-shells, the connecting portion defines a shaped hollow space forming a duct for piloting the flame between the first flaming front and the second flaming front. The shaped form of the connecting portion guarantees the contact between the two half-shells thus preventing problems during the assembly step. However, the contact is limited to surfaces with a reduced size, mainly pinpoints or linear, which do not obstruct the passage of the pilot flame. More specifically, the contact is limited to the point of intersection between walls 18 of corresponding depressions and/or elevations of the two half-shells.

Moreover, the entire connecting portion (that is, the assembly of the two half-shells) has a sequence of depressions and elevations which generate a hollow space with an undulating path in a direction perpendicular to the coupling plane. This means that the hollow space extends without interruption from the first flaming front to the second flaming front whilst guaranteeing the pinpoint contact between the first half-shell and the second half-shell. The coupling between the two half-shells is precise and immediate thanks to the reciprocal contact and the fact that it is not necessary to maintain in the coupling step a minimum distance between the two half-shells such as to create the piloting hollow space. This allows the assembly steps to be accelerated and to guarantee an efficiency of the piloting both from one burner to the other and in the same burner, with variations to the temperature.

According to a possible embodiment, the first flaming front and second flaming front are defined by the edge portions of the half-shells such shaped as to form a sequence of depressions and elevations, for example of a different shape to those of the connecting portion.

Preferably, each flaming front is defined by a sequence of substantially cylindrical channels 23, with reference to an inner surface of the body, made in a half-shell in a direction perpendicular to the longitudinal direction of the body. The substantially cylindrical channels 23 define, with reference to an inner surface of the body, depressions with respect to a flat surface 24 defining the coupling plane 8. In the other half-shell the flaming front is defined by a sequence of elevations 25, with reference to an inner surface of the body, delimited by inclined walls 26. Advantageously, the elevations have a triangular or trapezoidal shape whose vertex or minor base is at the outer edge E of the edge portion.

The cylindrical channels of a half-shell and the elevations of the other half-shell (seen with reference to the inner surface of the edge portion) mutually match to form respective flame holes connected by a shaped hollow space forming a flame piloting duct. The shaped hollow space is formed by the coupling between the flat surfaces 24 of a half-shell and depressions 25*a* of the other half-shell (seen with reference to the inner surface of the edge portion) wherein the contact is limited to surfaces with a reduced size, mainly pinpoints or linear, which do not obstruct the passage of the pilot flame. Moreover, the entire edge portion (that is, the assembly of the two half-shells) has a sequence of depressions and elevations which generate a hollow space with an undulating path in a direction perpendicular to the coupling plane.

According to a possible embodiment, the first and the second half-shells which are positioned side by side are identical.

Advantageously, the body comprises fasteners of elongated accessories, for example thermocouples or ignition devices, comprising at least one pair of wings 27 each having a hole 28 for housing an accessory. The two wings are designed for being positioned parallel to each other and with the holes aligned in such a way as to form a channel for inserting the accessory. In the examples illustrated there are two pairs of wings 27 for two different accessories to be positioned on opposite sides of the body.

According to a possible embodiment, the first and second half-shells are mutually crimped at protrusions 29 formed in the inner chamber.

Each half-shell is made by cutting and shaping a metal sheet. Preferably, each half-shell comprises a supporting foot and a pair of wings designed for being suitably bent.

Each half-shell, with reference to the inner surface, comprises a first section 30 of the edge portion defined by the sequence of the substantially cylindrical channels 23 and a second section 31 of the edge portion defined by the sequence of elevations 25 delimited by the inclined walls 26. The first section 30 is positioned on the opposite side of the second section 31 relative to the inner chamber. The two sections are connected by the connecting wall 13.

Considering a direction perpendicular to the longitudinal direction of the body, an axis 32 of a substantially cylindrical channel corresponds to an axis of symmetry of an elevation 25 positioned on the opposite side of the channel.

After the cutting and shaping, at least of the elevations and depressions, two half-shells are coupled in a mirror-image manner and crimped at the protrusions 29.

The coupling of the two half-shells is simplified by the shaped form of the connecting portion and of the flaming fronts which allow the two half-shells to be in contact automatically keeping a hollow space designed to pilot the flame between the two flaming fronts and, if necessary, to also pilot the flame between adjacent flame holes. The remaining sections of the edge portion, for example at the Venturi pipe, can be bent or otherwise connected.

Lastly, the supporting feet and the wings are shaped.

The burner according to this invention achieves the preset aims as it allows the use of only two components whilst allowing a piloting of the flame. This results in a lower production cost and a greater reliability of the result since the hollow space which guarantees the piloting of the flame is always constant both between different burners and as part of the same burner at different temperatures.

In use, the burner allows a series of main flames to be achieved, each positioned at the outlet of the substantially cylindrical channels 23, joined together by respective pilot flames of smaller extension each positioned between two adjacent substantially cylindrical channels 23. A further pilot flame of smaller extension relative to the main flame extends for the entire perimeter of the connecting portion.

The invention claimed is:

1. A burner for an oven or grill, comprising:

a flat and elongated body extending in a major longitudinal direction and confining an inner chamber configured to receive a comburent and combustible mixture;

wherein the body is formed with two half-shells mutually superposed and coupled in mirror-image relationship and comprising edge portions defining a coupling plane of the two half-shells, wherein the body comprises a first series of flame holes defining a first flaming front and a second series of flame holes defining a second flaming front, the first and second flaming fronts being disposed at the coupling plane of the two half-shells, on opposite sides of the inner chamber and in communication therewith, wherein the body comprises a connecting portion between the first flaming front and the second flaming front at the coupling plane of the two half-shells at an end of the inner chamber, wherein the connecting portion is defined by respective connecting walls of the two half-shells extending parallel to the coupling plane in a sequence of depressions and elevations between the first flaming front and the second flaming front, and configured to transfer flame, wherein the depressions and elevations are bounded by side walls of the connecting portion, wherein at least one side wall of at least one depression or elevation of a first half-shell intersects a side wall of a corresponding depression or elevation of a second half-shell, and wherein the connecting portion has a sequence of depressions and elevations that generate a hollow space with an undulating path in a direction perpendicular to the coupling plane.

2. The burner of claim 1, wherein the connecting portion is of curved shape.

3. The burner of claim 1, wherein in a mirror-image superposed and coupled condition of the two half-shells so as to form the body to a depression of the first half-shell substantially corresponds an elevation of the second half-shell, taking into account an inner surface of the connecting portion.

4. The burner of claim 1, wherein at least one side wall of at least one depression or elevation is inclined in the coupling plane relative to a radial direction of the connecting portion.

5. The burner of claim 1, wherein the depressions and elevations of the connecting portion are bounded by side walls, and wherein at least one side wall of the at least one depression or elevation of the first half-shell is parallel to a side wall of a corresponding depression or elevation of the second halt-shell.

6. The burner of claim 1, wherein the depressions and elevations of the connecting portion comprise a flat base parallel to the coupling plane.

7. The burner of claim 1, wherein the connecting wall of the first half-shell and the connecting wall of the second half-shell in side-by-side relationship with the first half-shell are identical.

8. The burner of claim 1, wherein the connecting portion comprises, with reference to an inner surface thereof, depressions of triangular or trapezoidal shape whose vertex or minor base is toward an inside of the body.

9. The burner of claim 1, further comprising:

a supporting toot associated with each halt-shell at the connecting portion and including extensions of corresponding depressions with reference to an inner surface of the body.

10. The burner of claim 1, wherein the first flaming front and second flaming front are rectilinear, and parallel to each other and to the longitudinal direction of the body.

11. The burner of claim 1, wherein the first flaming front and second flaming front are defined by the edge portions of the half-shells so shaped as to form the sequence of depressions and elevations.

12. The burner of claim 1, wherein the first and second half-shells in side-by-side relationship are identical, and comprise fasteners of elongated accessories that include two wings configured to be parallel to a hole for housing an accessory.

13. The burner of claim 1, wherein the first and second half-shells are mutually crimped at protrusions formed in the inner chamber.

14. The burner of claim 1, wherein the hollow space extends without interruption from the first flaming front to the second flaming front.

15. The burner of claim 1, wherein the depressions and elevations of the connecting portion mutually coupled have different shapes.

16. The burner of claim 2, wherein the connecting portion is of a circular arc shape extending for approximately 180°.

17. The burner of claim 3, wherein in a mirror-image superposed and coupled condition of the two half-shells so as to form the body, the depression of the first half-shell has a shape different from a corresponding elevation of the second half-shell.

18. The burner of claim 5, wherein the side wall of a depression or elevation of the first half-shell positioned at an intermediate portion of the connecting portion is parallel to a side wall of a depression or elevation at the second half-shell.

19. The burner of claim 6, wherein the coupling plane is coincident with an inner surface of the connecting wall, at the flat base of the depressions and/or elevations.

20. The burner of claim 11, wherein each flaming front is defined by a sequence of substantially cylindrical channels formed in a half-shell in a direction perpendicular to the longitudinal direction of the body, with reference to an inner surface of the body, and by a sequence of elevations bounded by inclined walls formed in the other half-shell, with reference to an inner surface of the body, wherein the cylindrical channels and elevations mutually match to form respective flame holes connected by a shaped hollow space forming a flame piloting duct.

* * * * *